US009853348B2

(12) United States Patent
Lee et al.

(10) Patent No.: US 9,853,348 B2
(45) Date of Patent: Dec. 26, 2017

(54) ELECTRONIC DEVICE AND ANTENNA DEVICE THEREOF

(71) Applicant: Samsung Electronics Co., Ltd., Gyeonggi-do (KR)

(72) Inventors: Woosup Lee, Gyeonggi-do (KR); Yeonwoo Kim, Gyeonggi-do (KR); Jungsik Park, Gyeonggi-do (KR); Seunggil Jeon, Gyeonggi-do (KR); Juseok Noh, Gyeonggi-do (KR); Jaebong Chun, Gyeonggi-do (KR); Hyunju Hong, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 32 days.

(21) Appl. No.: 14/873,595

(22) Filed: Oct. 2, 2015

(65) Prior Publication Data

US 2016/0104930 A1 Apr. 14, 2016

(30) Foreign Application Priority Data

Oct. 8, 2014 (KR) ..... 10-2014-0135898

(51) Int. Cl.
*H01Q 1/24* (2006.01)
*H01Q 1/40* (2006.01)
(Continued)

(52) U.S. Cl.
CPC ..... *H01Q 1/243* (2013.01); *H01Q 1/40* (2013.01); *H01Q 1/42* (2013.01); *H01Q 9/26* (2013.01);
(Continued)

(58) Field of Classification Search
CPC ..... H01Q 1/243; H01Q 1/42; H01Q 9/42; H01Q 9/26; H01Q 1/40; H01Q 21/29; H01Q 21/28
(Continued)

(56) References Cited

U.S. PATENT DOCUMENTS 5,048,118 A 9/1991 Brooks et al.
7,612,725 B2 11/2009 Hill et al.
(Continued)

FOREIGN PATENT DOCUMENTS

CN 101814649 A 8/2010
CN 202353552 U 7/2012
(Continued)

OTHER PUBLICATIONS

European Search Report, dated Mar. 10, 2016.
European Search Report dated Aug. 18, 2017.

*Primary Examiner* — Hoang Nguyen
(74) *Attorney, Agent, or Firm* — Cha & Reiter, LLC

(57) ABSTRACT

An electronic device having a housing formed of a conductive material, and an antenna device thereof. The electronic device includes a housing provided with a plurality of housing modules, and a printed circuit board positioned inside the housing, and having an antenna power feeding unit electrically connected to the printed circuited board. The plurality of housing modules may be at least partially formed of a conductive material. At least one of the conductive materials of the plurality of housing modules may be electrically connected to the antenna power feeding unit of the printed circuit board so as to function as an antenna of the electronic device. Various embodiments may be made based on the technical idea of the present disclosure.

21 Claims, 12 Drawing Sheets

(51) Int. Cl.

| | |
|---|---|
| ***H01Q 1/42*** | (2006.01) |
| ***H01Q 9/26*** | (2006.01) |
| ***H01Q 9/42*** | (2006.01) |
| ***H01Q 21/28*** | (2006.01) |
| ***H01Q 21/29*** | (2006.01) |

(52) U.S. Cl.
CPC ..... *H01Q 9/42* (2013.01); *H01Q 21/28* (2013.01); *H01Q 21/29* (2013.01)

(58) Field of Classification Search
USPC ..... 343/702, 846, 872
See application file for complete search history.

(56) References Cited

U.S. PATENT DOCUMENTS

| | | | | |
|---|---|---|---|---|
| 8,270,914 | B2 | 9/2012 | Pascolini et al. | |
| 8,531,339 | B2 * | 9/2013 | Huang | H04M 1/0262 343/702 |
| 8,842,048 | B2 | 9/2014 | Kim et al. | |
| 9,059,506 | B2 | 6/2015 | Kim et al. | |
| 9,531,061 | B2 | 12/2016 | Han et al. | |
| 2004/0257283 | A1 | 12/2004 | Asano et al. | |
| 2005/0017909 | A1 | 1/2005 | Carpenter et al. | |
| 2009/0251373 | A1 | 10/2009 | Degner et al. | |
| 2010/0090921 | A1 | 4/2010 | Kim et al. | |
| 2010/0123632 | A1 | 5/2010 | Hill et al. | |
| 2011/0193752 | A1 | 8/2011 | Wang et al. | |
| 2011/0210897 | A1 | 9/2011 | Byun et al. | |
| 2012/0112969 | A1 | 5/2012 | Caballero et al. | |
| 2012/0112970 | A1 | 5/2012 | Caballero et al. | |
| 2012/0157175 | A1 | 6/2012 | Golko et al. | |
| 2012/0206302 | A1 | 8/2012 | Ramachandran et al. | |
| 2012/0212378 | A1 * | 8/2012 | Sung | H01Q 1/243 343/702 |
| 2012/0229347 | A1 | 9/2012 | Jin et al. | |
| 2012/0262345 | A1 * | 10/2012 | Kim | H01Q 1/243 343/702 |
| 2013/0078917 | A1 | 3/2013 | Cho et al. | |
| 2013/0222192 | A1 | 8/2013 | Seo et al. | |
| 2014/0266941 | A1 | 9/2014 | Vazquez et al. | |

FOREIGN PATENT DOCUMENTS

| | | | |
|---|---|---|---|
| CN | 103390796 | A | 11/2013 |
| EP | 2 109 185 | A1 | 10/2009 |
| EP | 2 290 742 | A1 | 3/2011 |
| KR | 10-2009-0131853 | A | 12/2009 |
| KR | 10-2010-0032681 | A | 3/2010 |
| KR | 10-2011-0002731 | A | 1/2011 |
| KR | 10-2011-0008606 | A | 1/2011 |
| KR | 10-2013-0096956 | A | 9/2013 |
| WO | 2012/153282 | A1 | 11/2012 |
| WO | 2014/025364 | A1 | 2/2014 |
| WO | 2014/098889 | A1 | 6/2014 |

* cited by examiner

ELECTRONIC DEVICE AND ANTENNA DEVICE THEREOF

CLAIM OF PRIORITY

This application claims priority from and the benefit under 35 U.S.C. §119(a) of Korean Patent Application No. 10-2014-0135898, filed on Oct. 8, 2014, which is hereby incorporated by reference for all purposes as if fully set forth herein.

BACKGROUND

1. Field of the Disclosure

Various embodiments of the present disclosure relate to an electronic device having a housing that is formed of a conductive material, and an antenna device thereof.

2. Description of the Related Art

Thanks to the remarkable development of information communication technologies and semiconductor technologies, the distribution and use of electronic devices have been rapidly increasing to unprecedented levels. In addition, the development of more recent electronic devices has shown an increasing convergence of cuntionality that was previously performed by separate electronic devices. For example, a mobile communication terminal provides various functions, such as a TV viewing function (e.g., utilizing mobile broadcasting, such as Digital Multimedia Broadcasting (DMB) or Digital Video Broadcasting (DVB)), music playing function (e.g., MP3 (MPEG Audio Layer-3)), a still image or moving image photographing function, an Internet connection function, and a radio receiving function, in addition to ordinary communication functions, such as voice communication and message transmission/reception.

Meanwhile, such recent electronic devices may include one or more antennas in order to provide various wireless communication functions. The electronic devices may include, for example, a mobile communication antenna, a digital broadcasting reception antenna, a Bluetooth antenna, a Global Positioning System (GPS) antenna, and a Near Field Communication (NFC).

SUMMARY

However, as the functionality of such electronic devices increases, there is also a consumer demand to reduce the size of such electronic devices, particularly for handheld devices. Therefore, there can be difficulty in providing multiple antennas in a limited area that can operate with a minimum of interference.

In addition, such electronic devices may include a housing that is formed of a conductive material, such as a metal, and the construction of such conductive housing has increased. For example, there has been an increase in the manufacture of electronic devices including a housing that is at least partially formed of a metal. However, conventional electronic devices including a housing formed of a conductive material have a problem in that their antenna function is degraded. As a result, there is a need in art is to provide a measure that is capable of preventing the degradation of a radiation function in electronic devices including a housing that is formed of a conductive material.

According to various embodiments of the present disclosure, an electronic device includes a housing constructed of a plurality of housing modules, at least part of each housing modules is formed of a conductive material. The housing, through its construction utilizing a conductive material for at least one of the plurality of housing modules, may be utilized as a constituent element of an antenna.

According to various embodiments of the present disclosure, an electronic device may include a housing including a plurality of housing modules, and a printed circuit board arranged within the housing, and at least one antenna power feeding unit electrically connected to the printed circuit board. The plurality of housing modules may be at least partially formed of a conductive material, and at least one of the conductive materials used in the plurality of housing modules may be electrically connected to the at least one antenna power feeding unit of the printed circuit board to function as an antenna of the electronic device.

According to various embodiments of the present disclosure, a housing of an electronic device may include a plurality of housing modules configured to be assembled with each other. The plurality of housing modules may be at least partially formed of a conductive material, and at least one of the conductive materials of the plurality of housing modules may be electrically connected with an antenna power feeding unit.

According to various embodiments of the present disclosure, an electronic device may include a first module, on which a display device is mounted, a second module fastened (i.e. attached) to the first module, and a printed board mounted on the first module. The second module may be constructed of both a conductive material and a non-conductive material, in which the conductive material may be electrically connected to the printed circuit board so as to function as an antenna for transmitting/receiving a wireless signal, and the non-conductive material may include an auxiliary pattern that is electrically connected to the conductive material. The auxiliary pattern may be configured to adjust a characteristic of the antenna.

As described above, according to various embodiments of the present disclosure, the electronic device and the antenna thereof utilize a conductive material, which is included in at least one of a plurality of housing modules that constitute the housing of the electronic device, to act as an antenna. Thus, it is possible to the prevent degradation of radiation performance in a manner heretofore unknown.

In addition, according to various embodiments of the present disclosure, an antenna is tunable by changing only some of the plurality of housing modules that constitute housing, rather than the entire housing. This enables the reduction of development costs at the time of developing electronic devices that have the same design but are different from each other in terms supporting different or overlapping frequency bands.

BRIEF DESCRIPTION OF THE DRAWINGS

The above and other objects, features, and advantages of the present disclosure will become more apparent to a person of ordinary skill in the art from the following detailed description in conjunction with the accompanying drawings, in which.

DETAILED DESCRIPTION

Figure 1A:
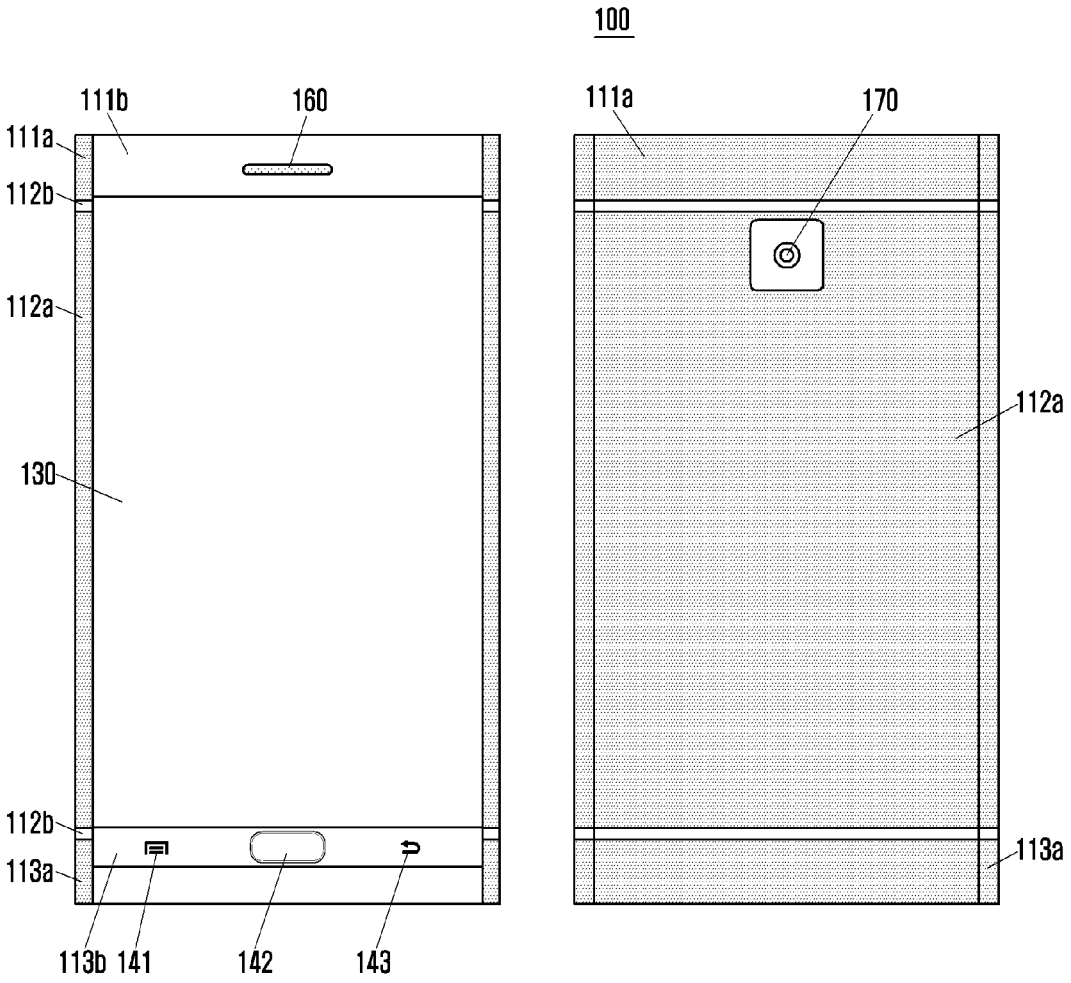
FIG. 1A is a view illustrating front and rear surfaces of an electronic device according to an embodiment of the present disclosure.

Hereinafter, various embodiments of the present disclosure will be described with reference to the accompanying drawings. Specific embodiments are shown in the drawings and the detailed descriptions are given in corresponding sections, but an artisan should understand that the disclosure and the appended claims are not limited to the description provided herein for illustrative purposes For example, the present disclosure includes various embodiments in which modifications and changes may be made therein. Various embodiments of the present disclosure should be construed by an artisan to cover all modifications, equivalents, and/or alternatives falling within the spirit and scope of the present disclosure.

In the description of the drawings, identical or similar reference numerals are used to designate identical or similar elements.

As used in various portions of the present disclosure, the expressions "include", "may include" and other conjugates refer to the existence of a corresponding disclosed function, operation, or constituent element, and do not limit one or more additional functions, operations, or constituent elements to the description included herein.

Further, as used in various embodiments of the present disclosure, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

The term "or" used in various embodiments of the present disclosure includes any or all of combinations of listed words. For example, the expression "A or B" may include A, may include B, or may include both A and B.

The expressions such as "first", "second", or the like used in various embodiments of the present disclosure may modify various component elements in the various embodiments but do not limit corresponding component elements. For example, the above expressions do not limit the sequence and/or importance of the elements. The above expressions are used merely for the purpose of distinguishing an element from the other elements. For example, a first user device and a second user device indicate different user devices although both of them are user devices and typically does not imply there is a sequence of elements. For example, a first element may be termed a second element, and likewise a second element may also be termed a first element without departing from the scope of various embodiments of the present disclosure.

In the case where an element is referred to as being "connected" or "accessed" to other elements, it should be understood that not only the element is directly connected or accessed to the other elements, but also another intermediate element may exist between them. Contrarily, when an element is referred to as being "directly coupled" or "directly connected" to any other element, it should be understood that no element is interposed therebetween.

The terms as used in embodiments of the present disclosure are used to facilitate understanding of a specific embodiment, and not to limit the present disclosure and appended claims. As used herein, the singular forms are intended to include the plural forms as well, unless the context clearly indicates otherwise.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of the art, and are not to be interpreted to have ideal or excessively formal meanings unless clearly defined in the present disclosure.

For example, the electronic device may include at least one of a smartphone, a tablet Personal Computer (PC), a mobile phone, a video phone, an electronic book (e-book) reader, a desktop PC, a laptop PC, a netbook computer, a Personal Digital Assistant (PDA), a Portable Multimedia Player (PMP), an MP3 player, a mobile medical appliance, a camera, and a wearable device (e.g. a Head-Mounted-Device (HMD) such as electronic glasses, electronic clothes, an electronic bracelet, an electronic necklace, an electronic "appcessory", electronic tattoos, or a smartwatch). just to name a few non-limiting devices.

According to some embodiments, the electronic device may be a smart home appliance. For example, the smart home appliance may include at least one of a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic photo frame, just to name some non-limiting examples of appliances.

According to some embodiments, the electronic device may include at least one of various medical appliances (e.g., magnetic resonance angiography (MRA), magnetic resonance imaging (MRI), computed tomography (CT), and ultrasonic machines), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop, just to name some more non-limiting applications.

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter).

The electronic device according to various embodiments of the present disclosure may be a combination of one or more of the aforementioned various devices and/or applications. Further, the electronic device according to various embodiments of the present disclosure may be a flexible device. Further, it will be apparent to those skilled in the art that the electronic device according to various embodiments of the present disclosure is not limited to the aforementioned devices.

Hereinafter, an electronic device according to various embodiments of the present disclosure will be described with reference to the accompanying drawings. The term "user" as used in various embodiments of the present disclosure may refer to a person who uses an electronic device or a device (e.g., artificial intelligence electronic device) that uses an electronic device.

Prior to detailed description, it is to be noted that, in the drawings, a conductive material and a non-conductive material will be distinguished by a difference in shading.

Figure 1B:
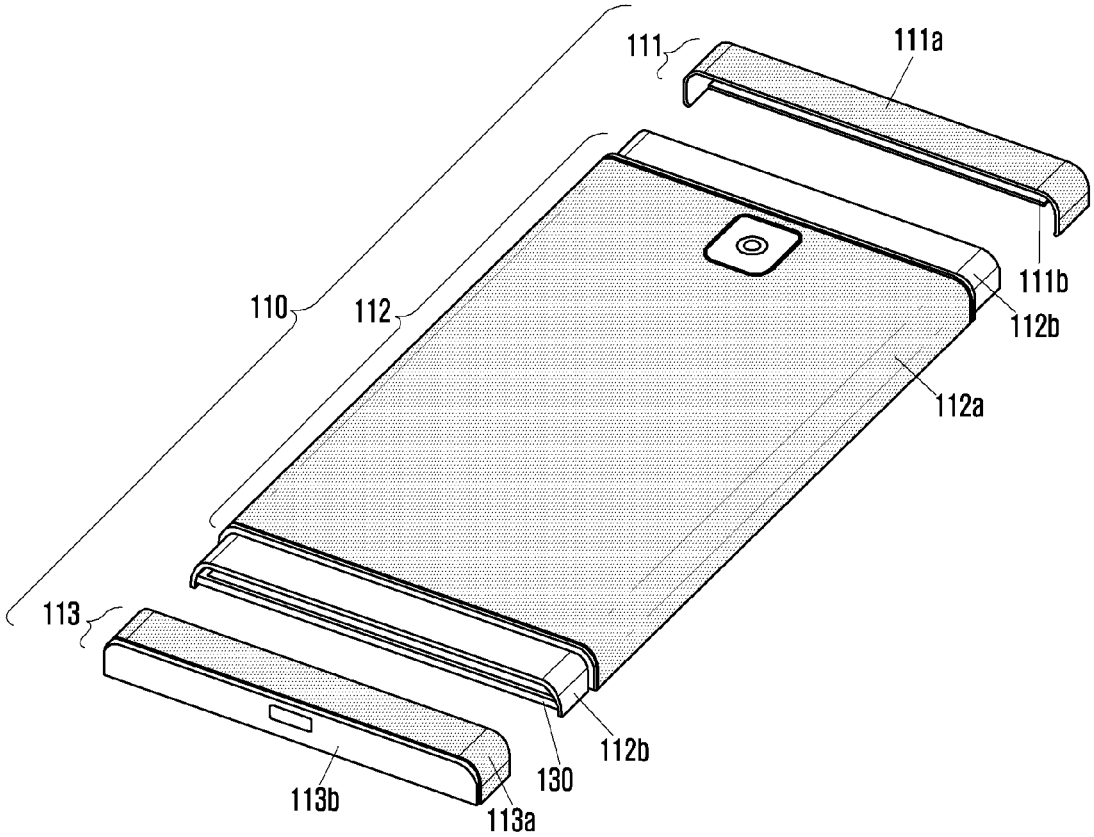
FIG. 1B is an exploded perspective view illustrating a plurality of housing modules that constitute a housing of the electronic device according to the embodiment of the present disclosure.

FIG. 1A is a view illustrating front and rear surfaces of an electronic device according to an embodiment of the present disclosure, and FIG. 1B is an exploded perspective view illustrating a plurality of housing modules that constitute a housing of the electronic device according to the embodiment of the present disclosure.

Referring to FIGS. 1A and 1B, an electronic device 100 according to an embodiment of the present disclosure may include a display unit 130 positioned on the front surface, a speaker 160 positioned above the display unit 130, and a plurality of keys 141, 142, and 143 below the display unit 130. In addition, a rear camera 170 may be positioned on the rear surface (back surface) of the electronic device 100.

With reference to FIG. 1B, the electronic device 100 may include a housing 110. The housing 110 may be formed of plastic, glass, ceramic, metal, any other proper material suitable to form a housing for an electronic device, or a combination of the aforementioned materials.

The housing 110 may include a plurality of housing modules 111, 112, and 113. For example, the housing 110 may be formed by assembling the plurality of housing modules 111, 112, and 113 together. The plurality of housing modules 111, 112, and 113 may be assembled such that at least one of them may be separated by a user without using a separate tool, for a non limiting example, a snap fit, press fit, interlocking fit, etc. For example, in order to insert or replace a battery (not illustrated), the user may separate at least one of the plurality of housing modules 111, 112, and 113. Alternatively, some of the plurality of housing modules 111, 112, and 113 may be mechanically connected by fasteners (e.g., by screws) such that they cannot be separated without using a tool (e.g., a screwdriver).

With continued reference to FIGS. 1A and 1B, the plurality of housing modules 111, 112, and 113 may be at least partially formed of a conductive material. For example, each of the plurality of housing modules 111, 112, and 113 may be formed of a conductive material 111*a*, 112*a*, or 113*a* and a non-conductive material 111*b*, 112*b*, or 113*b*. Alternatively, at least one of the plurality of housing modules 111, 1112, and 113 may be formed of only a conductive material.

The non-conductive materials 111*b*, 112*b*, and 113*b* may be formed of an insulator that does not conduct electricity, such as an injection-molded product (plastic). The conductive materials 111*a*, 112*a*, 113*a* may be formed of a metal. For example, the conductive materials 111*a*, 112*a*, and 113*a* may be formed of an alloy. The alloy may be selected from, for example, Steel Use Stainless (SUS), nickel steel, chrome steel, and nickel-chrome steel.

Each of the plurality of housing modules 111, 112, and 113 may be formed by joining the conductive materials 111*a*, 112*a*, and 113*a* and the non-conductive materials 111*b*, 112*b*, and 113*b*, respectively, through various methods. For example, the conductive materials 111*a*, 112*a*, and 113*a* and the non-conductive materials 111*b*, 112*b*, and 113*b* may be connected. respectively, by using, for example, double-sided tape or adhesive, or the conductive materials 111*a*, 112*a*, and 113*a* may be deposited or coated on the non-conductive materials 111*b*, 112*b*, and 113*b*, respectively, just to name some possible constructions. Alternatively, the plurality of housing modules 111, 112, and 113 may be formed through mechanical assembly (e.g., press-fitting) of the conductive materials 111*a*, 112*a*, and 113*a* with the non-conductive materials 111*b*, 112*b*, and 113*b*, respectively.

The conductive materials 111*a*, 112*a*, and 113*a*, which are respectively included in the plurality of housing modules 111, 112, and 113, may be electrically isolated from each other. In addition, the plurality of housing modules 111, 112, and 113 may be formed to be exposed to the outside of the conductive materials 111*a*, 112*a*, and 113*a*, respectively. In other words, the conductive materials 111*a*, 112*a*, and 113*a* included in the plurality of housing modules 111, 112, and 113 may form at least one side surface of the electronic device 100.

At least one of the conductive materials 111*a*, 112*a*, and 113*a* included in the plurality of housing modules 111, 112, and 113 may function as one constituent element of an antenna of the electronic device 100. For example, at least one of the conductive materials 111*a*, 112*a*, and 113*a* may function as an antenna, and the antenna can be suitable for one or more types of wireless transmission. The antenna element may comprise, for example, a mobile communication antenna for 2G (Generation), 3G or 4G mobile communication, a Bluetooth antenna for Bluetooth communication, a Near Field Communication (NFC) antenna, a wireless LAN antenna, a wireless charging antenna, a diversity antenna, or a Global Positioning System (GPS) antenna for position measurement. In addition, the antenna may be any of various types of antenna, such as a coupling antenna, a Planar Inverted-F Antenna (PIFA), a loop antenna, or a patch antenna.

At least one of the conductive materials 111*a*, 112*a*, and 113*a* may be electrically connected to the antenna so as to extend the ground area of the antenna, or may be connected to a ground area of a Printed Circuit Board (PCB) of the electronic device 100 so as to extend the ground area of the electronic device 100.

Meanwhile, the electronic device 100 illustrated in FIG. 1A is merely an example and does not limit the present disclosure to devices similar to what is shown in FIG. 1A. It will be understood by a person ordinarily skilled in the art that various embodiments of the present disclosure may be applied to various types of electronic devices. For example, while FIGS. 1A and 1B illustrates a bar-type electronic device, the embodiments of the present disclosure may also be applied to, for example, a folder-type electronic device, and a slide-type electronic device.

In addition, FIGS. 1A and 1B illustrate that the housing 110 of the electronic device 100 includes three modules. According to another embodiment of the present disclosure, however, the housing of the electronic device may be composed of two modules or four or more modules. Thus, the person of ordinary skill in the art understands and appreciates the the number of modules can be less than three, or far greater than four.

Figure 2:
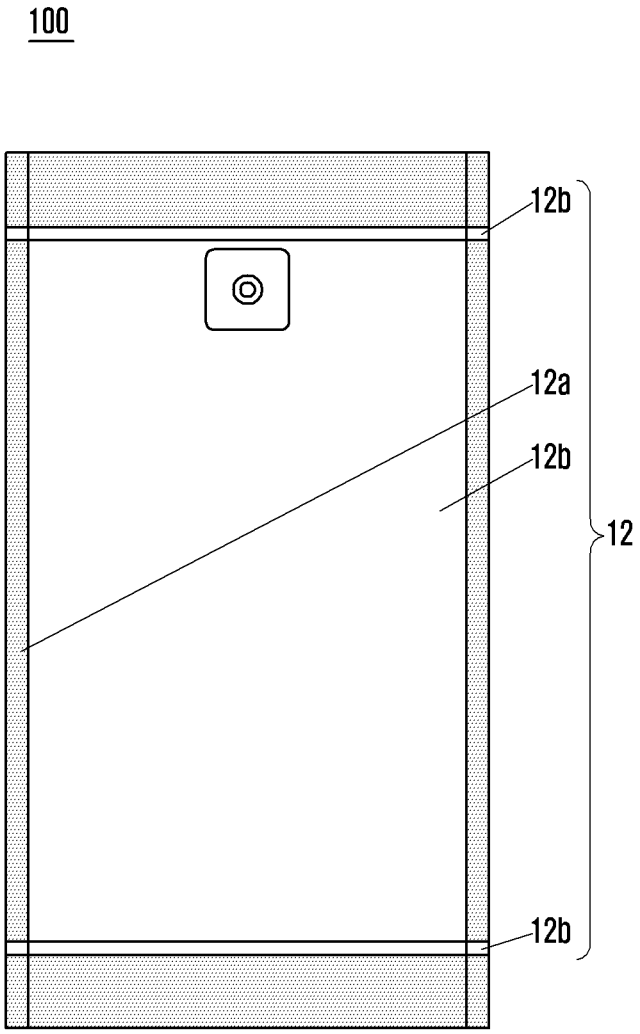
FIG. 2 is a view illustrating a rear surface of an electronic device according to an embodiment of the present disclosure.

FIG. 2 is a view illustrating a rear surface of an electronic device according to an embodiment of the present disclosure.

Referring now to FIG. 2, according to the embodiment of the present disclosure, the electronic device 100 includes a second module 12, of which the opposite side surfaces may be formed of a conductive material 12*a* and the rear surface may be formed of a non-conductive material 12*b*. Here, since the electronic device of FIG. 2 is similar to the electronic device 100 illustrated in FIG. 1A, detailed descriptions of the other components of the electronic device illustrated in FIG. 2 will be omitted.

Figure 3:
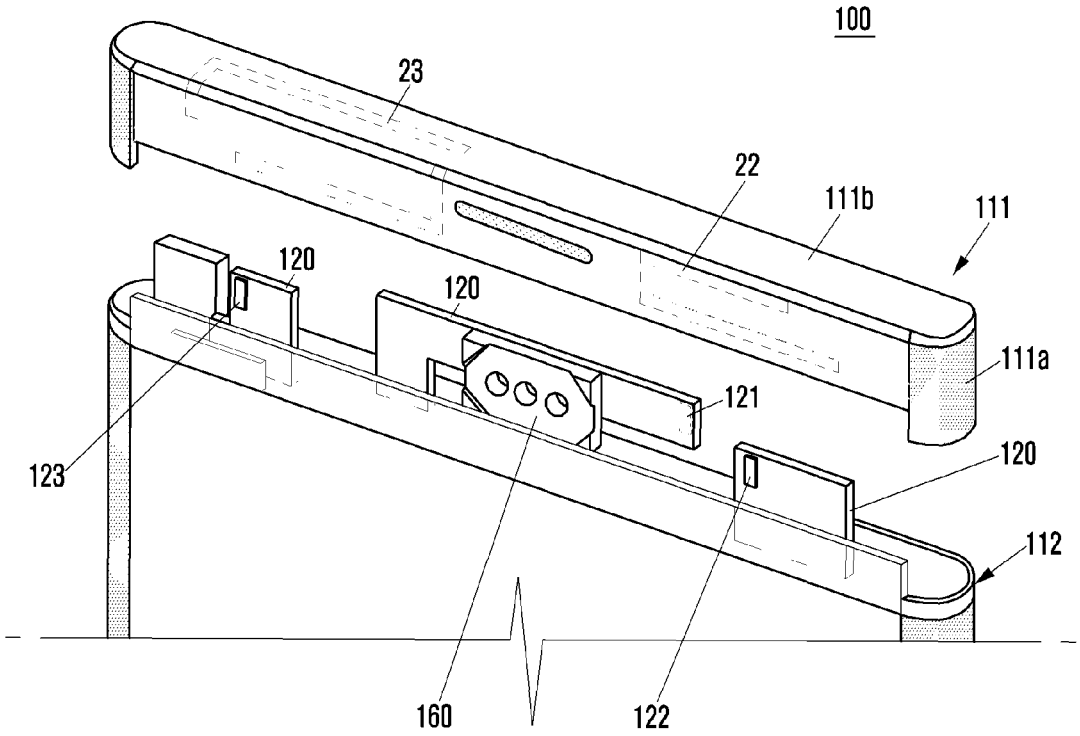
FIG. 3 provides a partially exploded view showing the antenna power feeding structure and the housing module that provides an antenna element according to an embodiment of the present disclosure.
Figure 4:
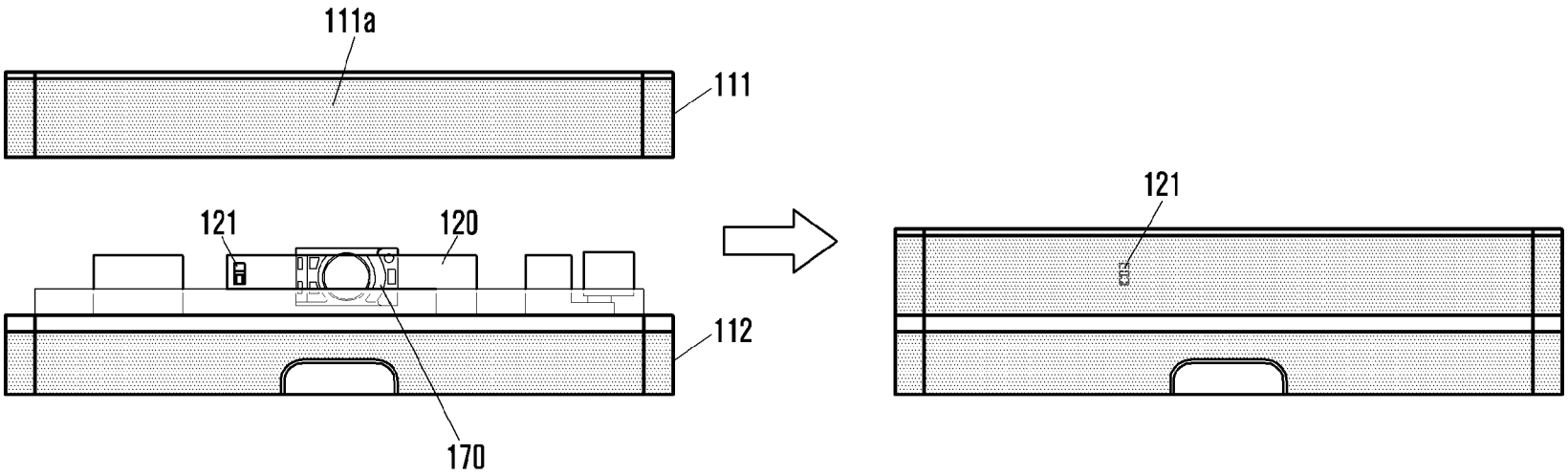
FIG. 4 is a rear view of the housing module including a rear camera module mounted on a printed circuit board according to an embodiment of the present disclosure.
Figure 5:
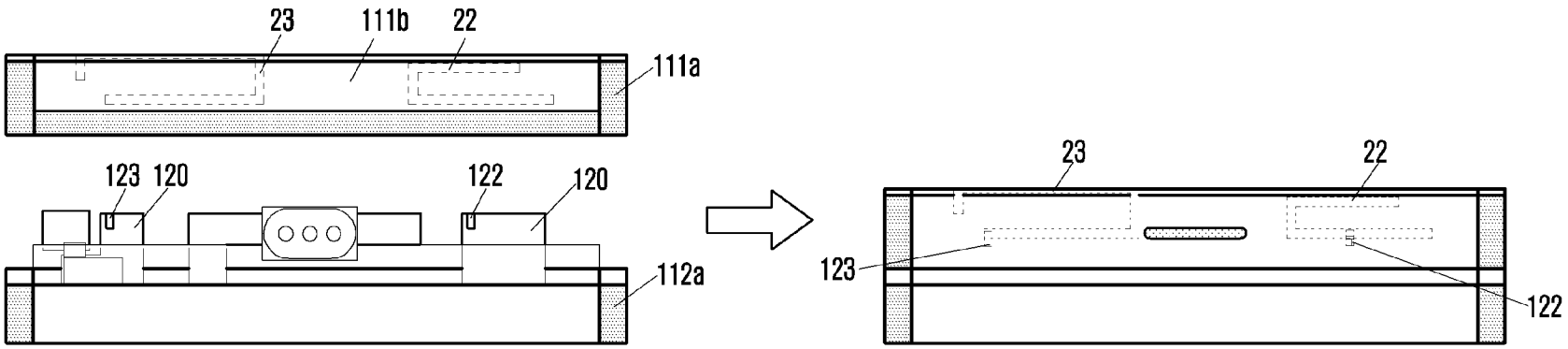
FIG. 5 illustrates of front view an antenna power feeding structure and housing of an electronic device according to an embodiment of the present disclosure.

FIGS. 3, 4 and 5 illustrate an antenna power feeding structure of an electronic device according to an embodiment of the present disclosure.

Hereinafter, an antenna power feeding structure will be described with reference to the first module 111 positioned in the upper end portion of the electronic device 100. In addition, descriptions will be made regarding a case where the first module 111 includes three antennas.

Referring now to FIGS. 3, 4 and 5, according to an embodiment of the present disclosure, the electronic device 100 may include a printed circuit board 120 arranged at least partially within inside the second module 112. FIG. 3 shows the first module 111 removed from the second module 112, and as shown in FIGS. 3 and 4, when the first module 111 is arranged on the second module 112, the printed circuit board 120 and power feeding unit 121 are within the connected portions of the housing, namely modules 111 and 112.

With reference to FIG. 3, on a front side of the printed circuit board 120, a speaker 160 and on a rear side of the printed circuit board (FIG. 4) a rear camera 170 may be mounted. Meanwhile, the printed circuit board 120, on which the speaker 160 and the rear camera 170 are mounted, may be separately formed from the main circuit board (not illustrated) of the electronic device 100. When the printed circuit board 120 is separately formed, the printed circuit board 120 may be connected to the main printed circuit board through various methods (e.g., using a Flexible PCB (FPCB) cable).

With reference to FIG. 4, the electronic device 100 may utilize the conductive material 111*a* of the first module 111 as a first antenna. For example, as illustrated in FIG. 4, when the first module 111 and the second module 112 are joined, the conductive material 111*a* may come in contact with the first power feeding unit 121 of the printed circuit board 120 at one side thereof. The printed circuit board 120 may include an elastic contact terminal in order to ensure stable contact with the conductive material 111*a*. For example, the contact terminal may be a C-clip. Alternatively, the first power feeding unit 121 of the printed circuit board 120 may be connected with the first antenna through a flexible cable (e.g., a coaxial cable).

The specifications (e.g., the shape, size, and thickness) of the conductive material 111*a* may be changed to correspond to the characteristics of the first antenna (e.g., a resonance frequency of the first antenna). Alternatively, according to a particular embodiment, the contact position between the first power feeding unit 121 and the conductive material 111*a* may be changed to correspond to the characteristics of the first antenna (e.g., resonance frequency). In other words, according to the embodiment of the present disclosure, the characteristics of the first antenna may be tuned by adjusting the specification of the conductive material 111*a* or its contact position with the first power feeding unit 121. It may be possible to have additional first modules 111 of different specifications of conductive material 111*a* provided with the device so that user can swap one first module for another first module.

According to a particular embodiment of the present disclosure, the printed circuit board 120 may further include a matching end (not illustrated) for tuning the characteristics of the first antenna. The matching end may include a resistor, an inductor, or a capacitor.

According to a particular embodiment of the present disclosure, as identified by the dashed lines in FIG. 4, a slit may be formed in at least an area of the conductive material 111*a* so as to adjust the characteristics of the first antenna.

With reference to FIG. 5, the first module 111 may include a second antenna 22 and a third antenna 23 on an inner surface of the non-conductive material 111*b*. As illustrated in FIG. 5, the second antenna 22 and the third antenna 23 may come in contact with the second power feeding unit 122 and the third power feeding unit 123, which are positioned on the printed circuit board 120, at one sides thereof, respectively, when the first module 111 and the second module 112 are joined with each other. The second power feeding unit 122 and the third power feeding unit 123 on the printed circuit board 120 may include elastic contact terminals so as to come in stable contact with the second antenna 22 and third antenna 23, respectively.

In the foregoing, it has been described that the first, second and third antennas are directly fed with power. However, the embodiments of the present disclosure are not limited thereto. For example, according to a some embodiments, the first, second and third antennas may be indirectly fed with power.

In addition, it has been described herein that the printed circuit board 120 includes first, second and third power feeding terminals for the first, second and third antennas. However, the printed circuit board 120 may further include first, second and third ground terminals for respective the first, second and third antennas.

In the foregoing, it has been described that the non-conductive material 111*b* includes separate antennas (e.g., the second and third antennas). However, the embodiments of the present disclosure are not limited thereto. For example, according to a particular embodiment of the present disclosure, the non-conductive material 111*b* may include an auxiliary antenna pattern for the first antenna. In other words, the conductive material 111*a* functioning as the first antenna and the auxiliary antenna pattern positioned on the non-conductive material 111*b* may be electrically connected so that they may function as one antenna. In such a case, the characteristics of the antenna may be tuned by changing the form of the auxiliary antenna pattern.

According to the above-mentioned embodiment, the electronic device may implement an antenna using at least one of the plurality of housing modules that constitute the housing. This may improve flexibility for antenna design at the time of developing an electronic device. For example, according to the embodiment of the present disclosure, the antenna characteristics of the electronic device may be tuned by changing (e.g. replacing) some of the modules that function as antennas with modules with antennas of a different characteristic without replacing the entire housing of the electronic device.

Figure 6:
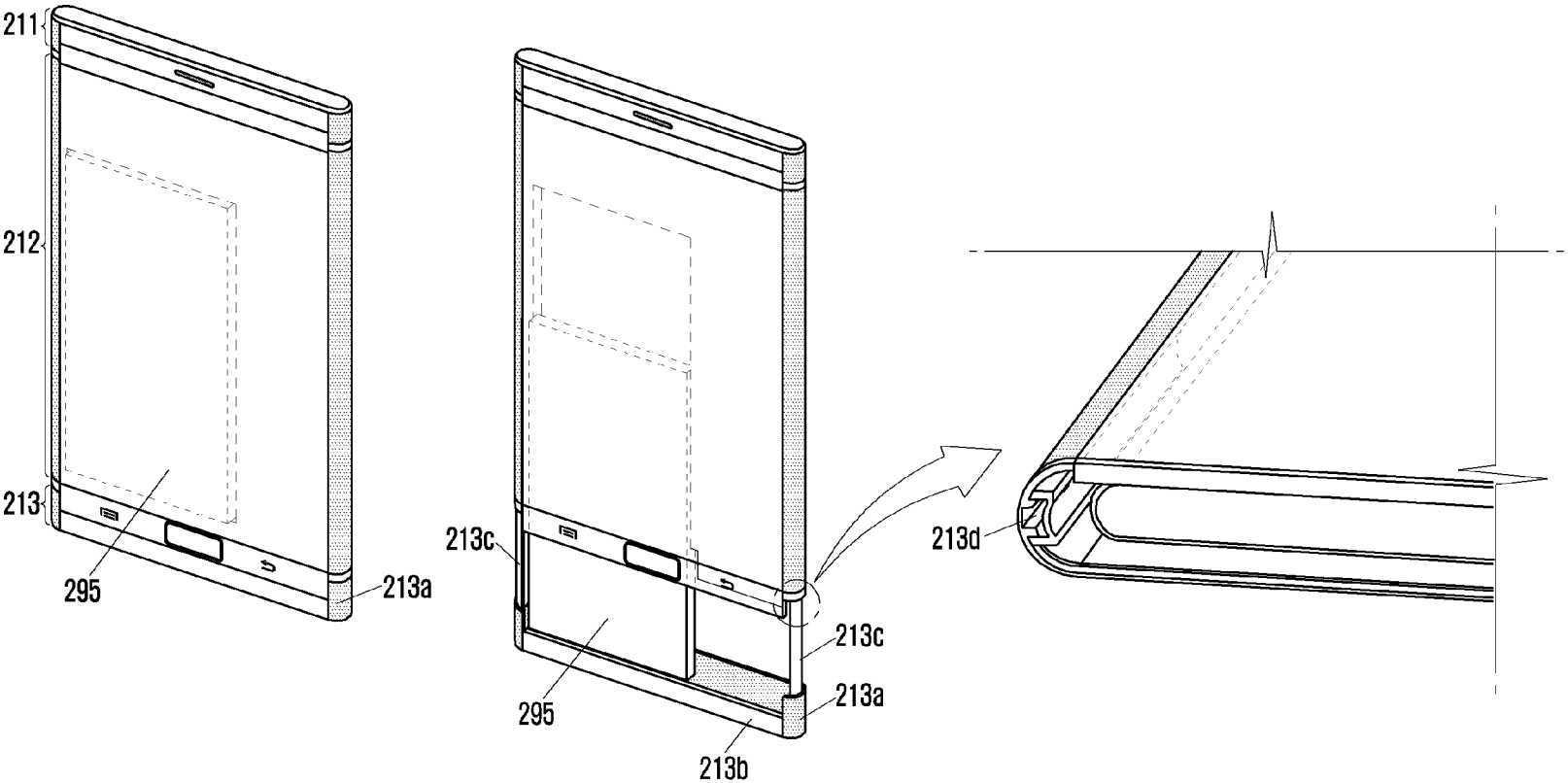
FIG. 6 is a view illustrating construction of a housing of an electronic device according to an embodiment of the present disclosure.

FIG. 6 is a view illustrating a housing of an electronic device according to an embodiment of the present disclosure.

Referring now to FIG. 6, according to an embodiment of the present disclosure, the electronic device may include a third module 213 configured to be detached/attached. For example, the third module 213 may be detached from/attached to a second module 212 in a sliding manner. The third module 213 includes sliding bars 213*c* on the opposite side surfaces thereof, and the second module 212 may include guide recesses 213*d* configured to guide the movement of the slide bars 213*c*. However, the embodiments of the present disclosure are not limited by the fact that the third module 213 is detached/attached in the sliding manner as shown. For example, the third module 213 may be fixed to be completely removable or to be rotatable at one side.

As described above with reference to FIGS. 3, 4 and 5, the third module 213 may include at least one antenna. For example, the conductive material 213*a* of the third module 213 may function as an antenna. In addition, the non-conductive material 213*b* of the third module 213 may include at least one antenna pattern or an auxiliary pattern on the inner surface thereof.

According to the above-mentioned embodiment of the present disclosure, an antenna may be formed using a module that is removable by the user. According to the embodiment of the present disclosure, since the third module 213 is capable of being detached/attached, the electronic device allows the replacement of the battery 295.

Figure 7:
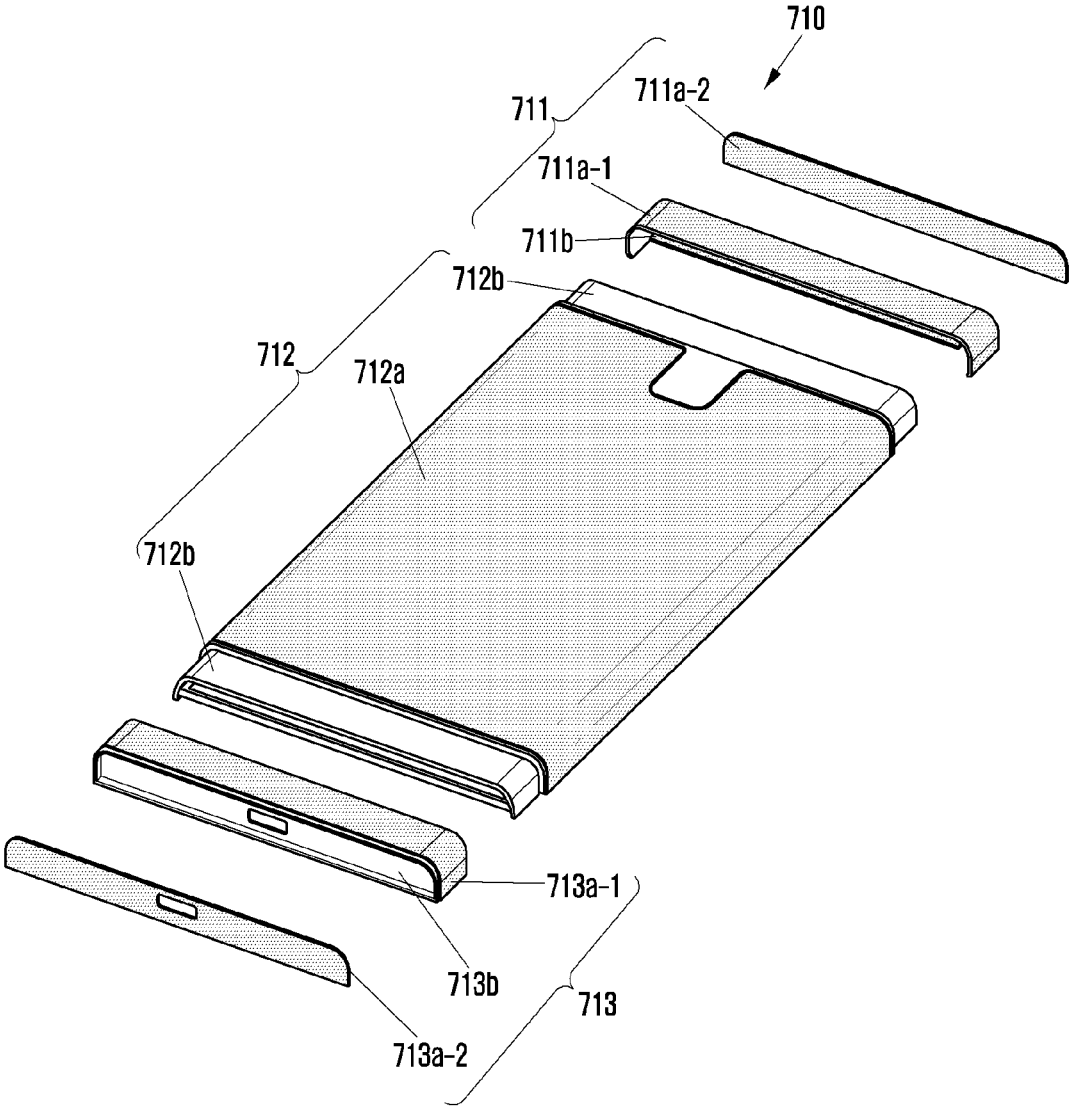
FIG. 7 is an exploded perspective view illustrating a housing of an electronic device according to an embodiment of the present disclosure.

FIG. 7 illustrates a housing of an electronic device according to other embodiment of the present disclosure.

Referring now to FIG. 7, according to an embodiment of the present disclosure, the housing 710 of the electronic device may include three modules: a first module 711, a second module 712, and a third module 713.

The first module 711 may include a first conductive material 711*a*_1 that forms the rear surface and both side surfaces, a second conductive material 711*a*_2 that forms the top end surfaces, and a first non-conductive material 711*b*. FIG. 7 illustrates the first conductive material 711*a*_1 and the second conductive material 711*a*_2 as separate components. According to another embodiment of the present disclosure, however, the first conductive material 711*a*_1 and the second conductive material 711*a*_2 may be integrally formed.

The second module 712 may include a third conductive material 712*a* and a second non-conductive material 712*b*. Meanwhile, FIG. 7 illustrates that the third conductive material 712*a* wraps the rear surface and both side surfaces of the second module 712. According to another embodiment of the present disclosure, however, the rear surface of the second module 712 may be formed of a non-conductive material, and just both side surfaces of the second module 712 may be formed of a conductive material, as illustrated in FIG. 1A.

The third module 713 may include a fourth conductive material 713*a*_1 that forms both side surfaces and the rear surface, a fifth conductive material 713*a*_2 that forms the top end surface, and a third non-conductive material 713*b*. Meanwhile, FIG. 7 illustrates the fourth conductive material 713*a*_1 and the fifth conductive material 713*a*_2 as separate components. According to another embodiment of the present disclosure, however, the fourth conductive material 713*a*_1 and the fifth conductive material 713*a*_2 may be integrally formed.

According to an embodiment of the present disclosure, the second conductive material 711*a*_2 and the fifth conductive material 713*a*_2, which are joined to the top surfaces of the first module 711 and the third module 713, respectively, may function as antennas. The top end surface of the first non-conductive material 711*b* may include a recess (not illustrated) so as to expose a contact terminal (not illustrated) to be in contact with the second conductive material 711*a*_2. Similar to this construction, the top end surface of the third non-conductive material 713*b* may include a recess (not illustrated) so as to expose a contact terminal (not illustrated) to be in contact with the fifth conductive material 713*a*_2. In other words, according to an embodiment of the present disclosure, the second conductive material 711*a*_2 and the fifth conductive material 713*a*_2 may be fed with power from a printed circuit board (not illustrated) through contact terminals (not illustrated), respectively. Alternatively, the second conductive material 711*a*_2 and the fifth conductive material 713*a*_2 may be indirectly fed with power.

The first module 711 and the third module 713 of FIG. 7 are similar to those described above, except that the first module 711 and the third module 713 further include the second conductive material 711*a*_2 and the fifth conductive material 713*a*_2, and the second conductive material 711*a*_2 and the fifth conductive material 713*a*_2 may be utilized as antennas. Therefore, detailed descriptions for the other components in FIG. 7 will be omitted.

Figure 8:
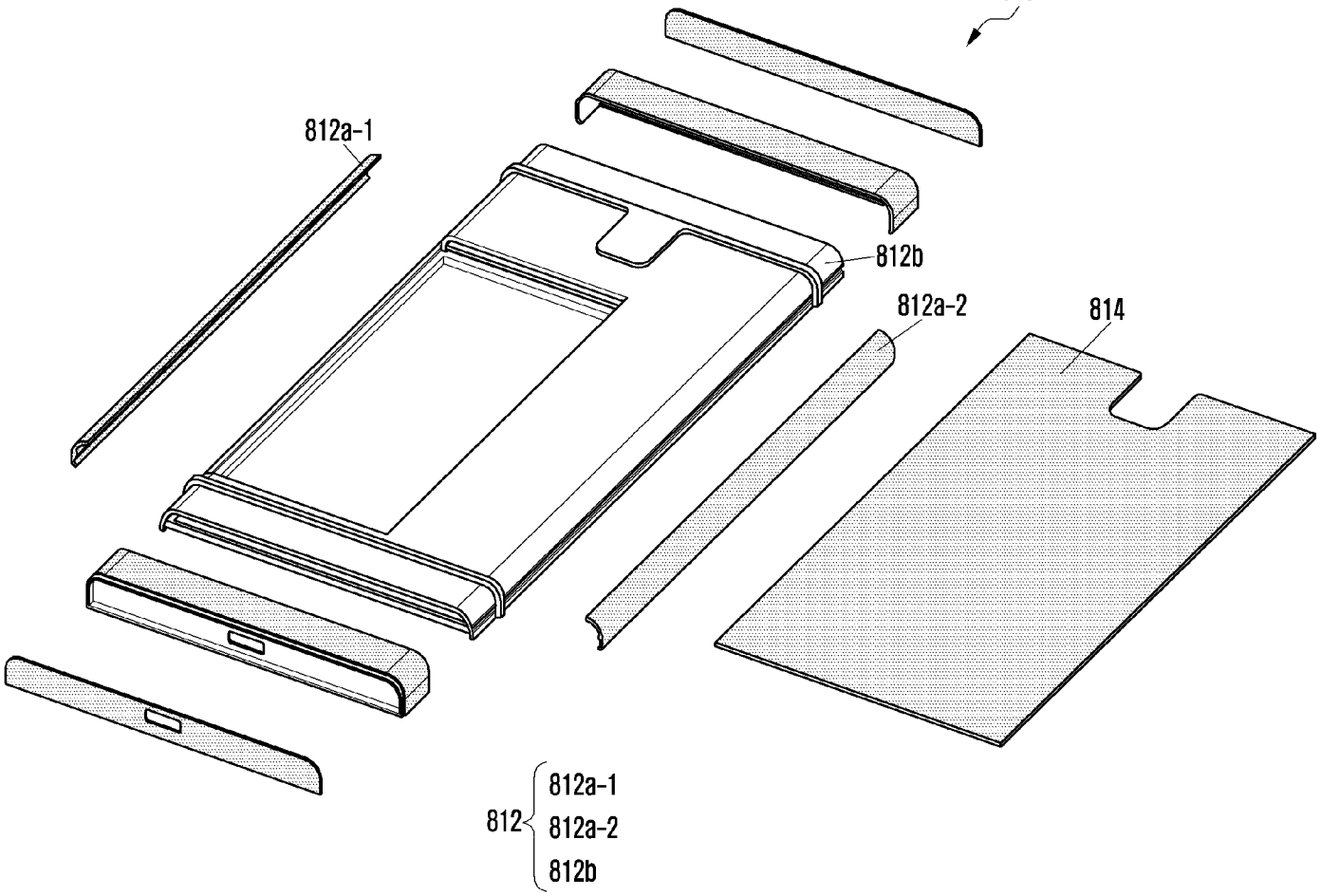
FIG. 8 is a view illustrating the various modules of a housing of an electronic device according to an embodiment of the present disclosure.

FIG. 8 is a view illustrating a housing of an electronic device according to an embodiment of the present disclosure.

Referring now to FIG. 8, according to an embodiment of the present disclosure, a second module 812, which constitutes a housing 810 of an electronic device, may include two conductive materials 812*a*_1 and 812*a*_2, and a non-conductive material 812*b*. Specifically, the second module 812 may include a first conductive material 812*a*_1 that forms one side surface of the housing 810, a second conductive material 812*a*_2 that forms the other side surface of the housing 810, and a non-conductive material 812*b*.

In addition, according to the embodiment of the present disclosure, the housing 810 may further include a cover case 814 that is removably joined to the rear surface of the electronic device. The cover case 814 may be a battery cover. The cover case 814 may be formed of a conductive material.

The first conductive material 812*a*_1, the second conductive material 812*a*_2, and the cover case 814 may be physically separated from each other. The first conductive material 812*a*_1, the second conductive material 812*a*_2, and the cover case 814 may function as constituent elements of an antenna. For example, the first conductive material 812*a*_1 and the second conductive material 812*a*_2 of the second module 812 may be utilized as an antenna. The cover case 814 may be utilized so as to extend a ground of the antenna or the electronic device. When the first conductive material 812*a*_1, the second conductive material 812*a*_2, and the cover case 814 function as an antenna, power feeding may be performed directly or indirectly through a printed circuit board.

Since the other components of FIG. 8 are similar to those described above, detailed descriptions thereof will be omitted.

Figure 9:
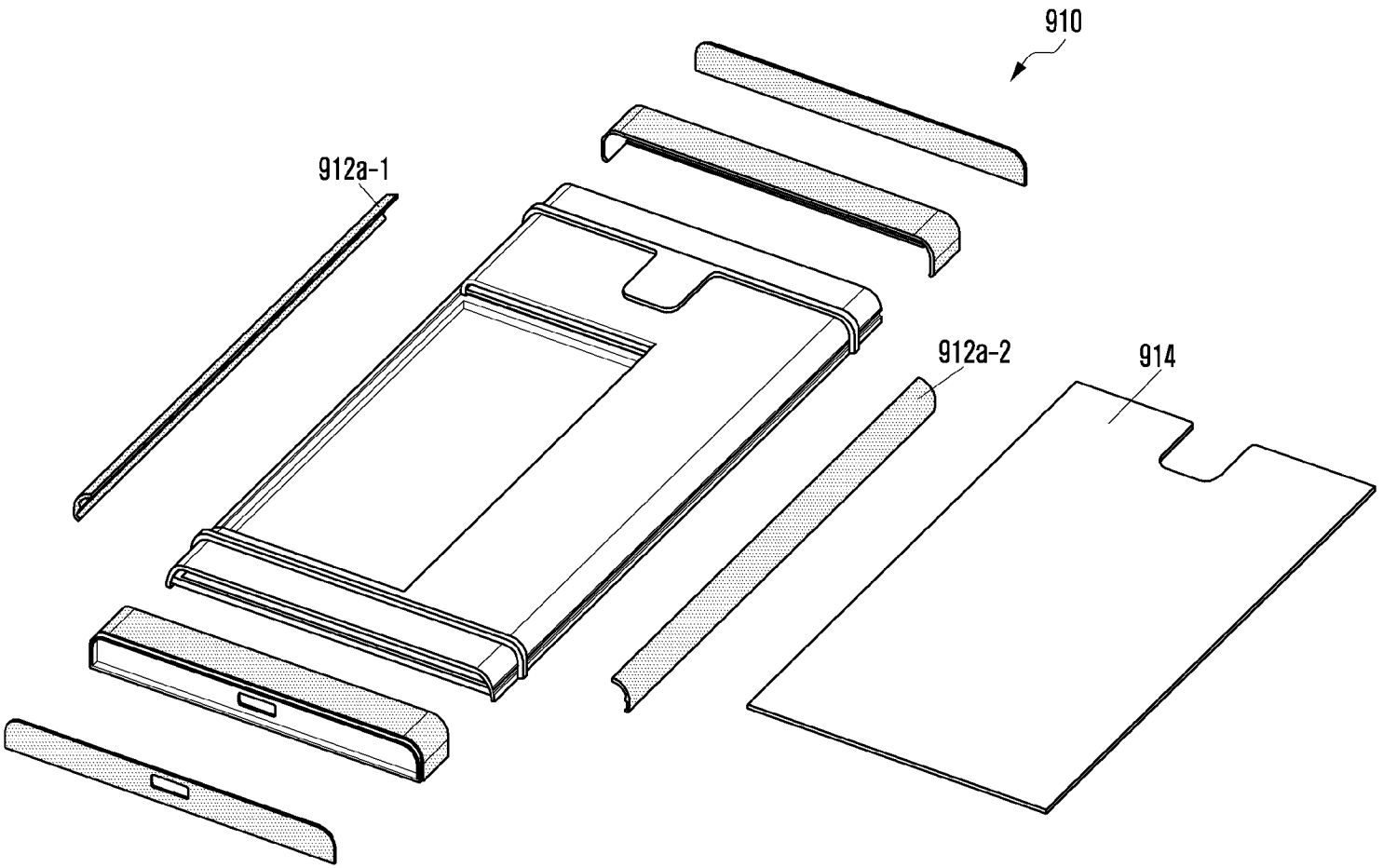
FIG. 9 is a view illustrating a backs side housing of an electronic device according to an embodiment of the present disclosure.

FIG. 9 is a view illustrating a housing of an electronic device according to an embodiment of the present disclosure.

Referring now to FIG. 9, a housing 910 of an electronic device according to an embodiment of the present disclosure may be similar to the housing 810 of FIG. 8. However, according to an embodiment of the present disclosure, a cover case 914, which is removably joined to the rear surface of the electronic device, may be formed of a non-conductive material. According to an embodiment of the present disclosure, the electronic device may utilize a first conductive material 912*a*_1 and a second conductive material 912*a*_2 as constituent elements of an antenna. Detailed descriptions of the other components of the housing of the electronic device illustrated in FIG. 9 described in other drawings will be omitted.

Figure 10:
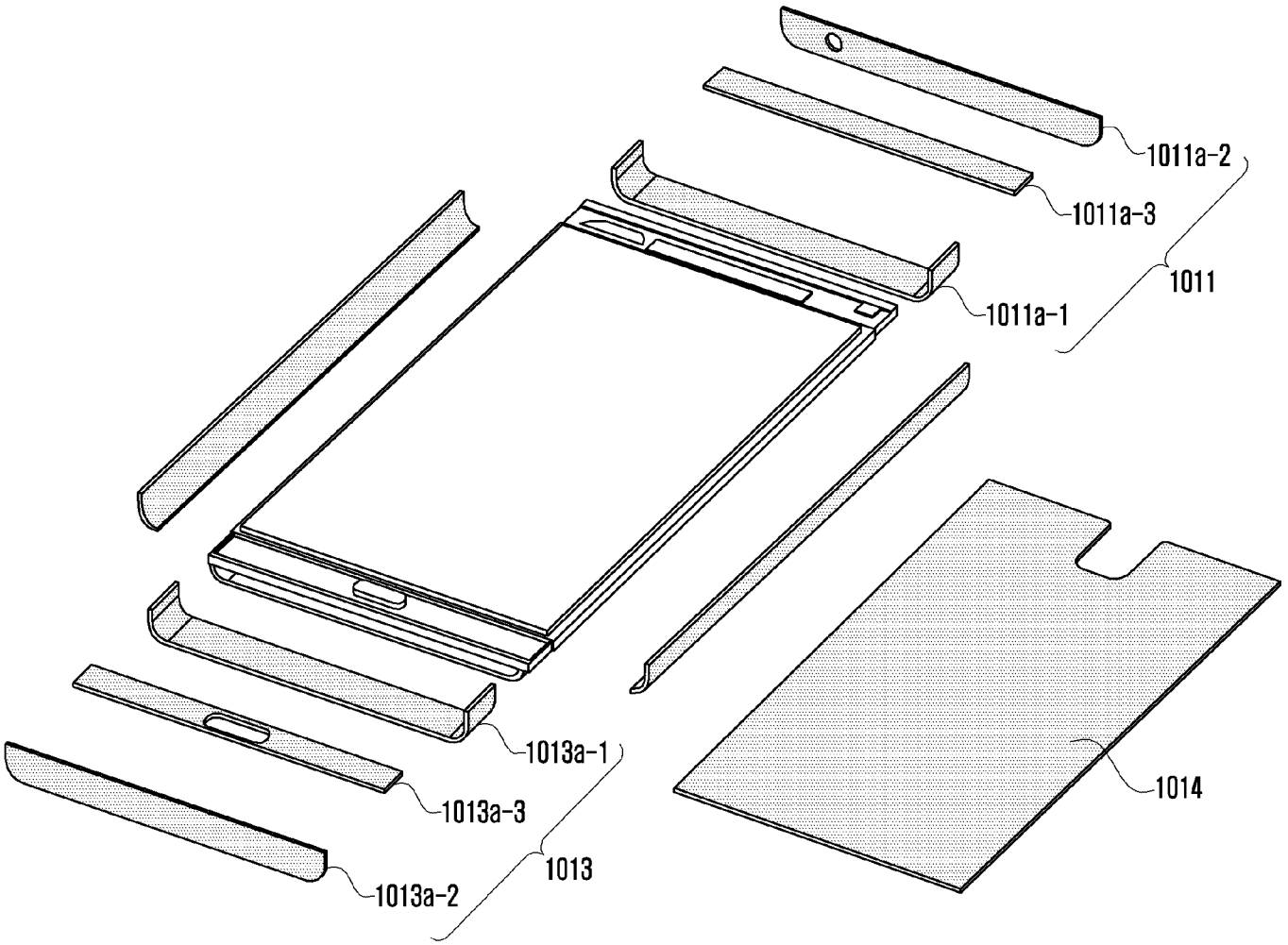
FIG. 10 is a view illustrating an inner side of the housing of an electronic device according to an embodiment of the present disclosure.

FIG. 10 is a view illustrating a housing of an electronic device according to an embodiment of the present disclosure.

Referring now to FIG. 10, according to an embodiment of the present disclosure, a first module 1011, which constitutes a housing of an electronic device according to an embodiment of the present disclosure, may include a first conductive material 1011*a*_1 that forms both side surfaces and the rear surface of the first module 1011, a second conductive material 1011*a*_2 that forms the top end surface, and a third conductive material 1011*a*_3 that forms the front surface. At least one of the first to third conductive materials 1011*a*_1 to 1011*a*_3 of the first module 1011 may function as an antenna. FIG. 10 illustrates the first conductive material 1011*a*1, the second conductive material 1011*a*_2, and the third conductive material 1011*a*_3 as being separated from each other. According to another embodiment of the present disclosure, however, at least two of the first to third conductive materials 1011*a*_1, 1001*a*_2, and 1011*a*_3 may be integrally formed.

Similarly to the first module 1011, the third module 1013 may include a fourth conductive material 1013*a*_1 that forms both side surfaces and the rear surface of the third module 1013, a fifth conductive material 1013*a*_2 that forms the top end surface, and a sixth conductive material 1013*a*_3. At least one of the fourth to sixth conductive materials 1013*a*_1, 1013*a*_2 and 1013*a*_3 of the third module 1013 may function as an antenna. According to another embodiment, however, at least two of the fourth to sixth conductive materials 1013*a*_1, 1013*a*_2, and 1013*a*_3 may be integrally formed.

The embodiment of the present disclosure illustrated in FIG. 10 may utilize the third conductive material 1011*a*_3 positioned on the front surface of the first module 1011 and the sixth conductive material 1013*a*_3 positioned on the front surface of the third module 1013 as antennas.

The cover case 1014 of the electronic device may be formed of a conductive material as described above with reference to FIG. 8, or a non-conductive material as described above with reference to FIG. 9.

Figure 11:
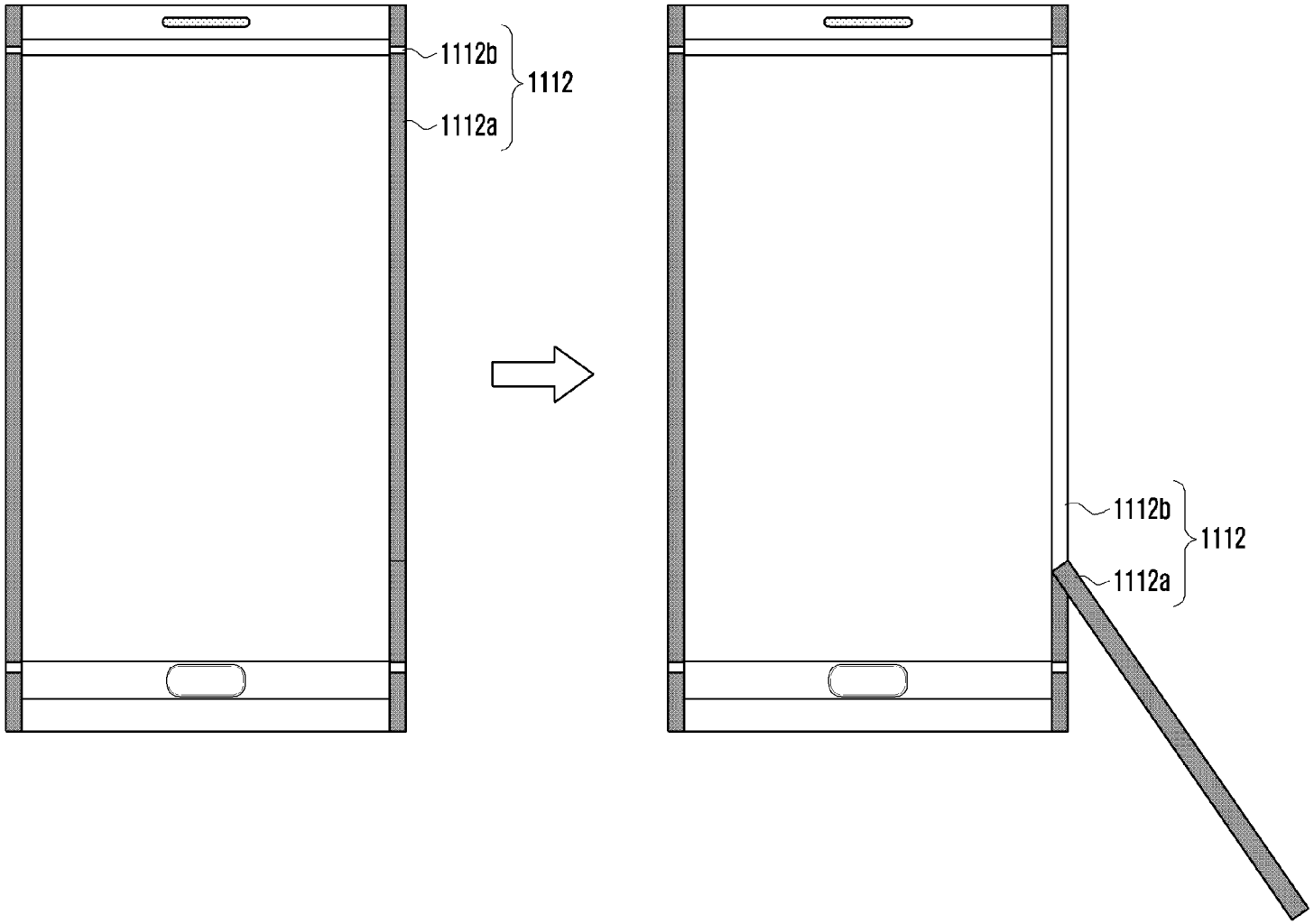
FIG. 11 is a view illustrating an antenna structure that is a portion of the housing of an electronic device according to an embodiment of the present disclosure.

FIG. 11 is a view illustrating an antenna structure of an electronic device according to an embodiment of the present disclosure.

Referring now to FIG. 11, a conductive material 1112*a* of a second module 1112 may be positioned on a Black Mark (BM) region. That is, the conductive material 1112*a* may overlap the BM region. The conductive material 1112*a* positioned on the BM region may be utilized as an antenna. For example, the conductive material 1112*a* positioned on the BM region may be utilized as an antenna for receiving digital broadcasting.

The conductive material 1112*a* positioned on the BM region may be moved from a non-conductive material 1112*b* of a second module 1112, as illustrated in FIG. 11. The electronic device may include a structure (not illustrated) that is capable of folding or unfolding of the conductive material 1112*a* positioned on the BM region. Regarding the structure, various well-known structures may be used, which should be understood by a person of ordinary skill in the art of the present disclosure. Thus, the detailed descriptions for such structure will be omitted.

The apparatuses and methods of the disclosure can be implemented in hardware, and in part as firmware or via the execution of software or computer code in conjunction with hardware that is stored on a non-transitory machine readable medium such as a CD ROM, a RAM, a floppy disk, a hard disk, or a magneto-optical disk, or computer code downloaded over a network originally stored on a remote recording medium or a non-transitory machine readable medium and stored on a local non-transitory recording medium for execution by hardware such as a processor, so that the methods described herein are loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc., that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. In addition, an artisan understands and appreciates that a "processor", "microprocessor", "controller", or "control unit" constitute hardware in the disclosure and appended claims that contain circuitry that is configured for operation. Under the broadest reasonable interpretation, the appended claims constitute statutory subject matter in compliance with 35 U.S.C. §101 and none of the elements are software per se. The term "module" as used in this application refers to the attachable structure of portions of the housing, and such components comprises statutory subject matter.

The definition of the term "unit" as referred to herein are to be understood as constituting hardware circuitry such as a CCD, CMOS, SoC, AISC, FPGA, a processor or microprocessor (a controller) configured for a certain desired functionality, or a communication module containing hardware such as transmitter, receiver or transceiver, or a non-transitory medium comprising machine executable code that is loaded into and executed by hardware for operation, in accordance with statutory subject matter under 35 U.S.C. §101 and do not constitute software per se.

The embodiments disclosed herein and shown in the drawings have been presented to help comprehension of the present disclosure, and are not intended to limit the scope of various embodiments of the present disclosure. Therefore, in addition to the embodiments disclosed herein, the scope of the various embodiments of the present disclosure should be construed to include all modifications or modified forms drawn based on the technical idea of the various embodiments of the present disclosure.

What is claimed is:

1. An electronic device comprising:

a housing including at least first and second housing modules mechanically attachable to and detachable from one another; and a printed circuit board that includes at least one antenna power feeding unit positioned thereon, wherein the printed circuit board is arranged within the housing, wherein the first and second housing modules are each at least partially formed of a conductive material, and the second housing module is partially formed of a non-conductive material, and the conductive material of the second housing module is electrically connected to the at least one antenna power feeding unit of the printed circuit board to function as an antenna of the electronic device, wherein when the first housing module is detached from the second housing module, the second housing module is detached from the at least one antenna power feeding unit and the printed circuit board.

2. The electronic device of claim 1, wherein the conductive material of each one of the first and second housing modules is physically separated from each other and forms at least one side surface of the housing.

3. The electronic device of claim 1, wherein the second housing module is formed by coating or depositing the conductive material on the non-conductive material.

4. The electronic device of claim 3, further including an antenna pattern formed on the non-conductive material of the second housing module.

5. The electronic device of claim 1, wherein the conductive material forms both side surfaces and a rear surface of the housing.

6. The electronic device of claim 1, wherein the conductive material forms a part of a top end surface, a bottom end surface, or a front surface of the housing.

7. The electronic device of claim 1, wherein the conductive material forms a side surface of the housing.

8. The electronic device of claim 1, wherein, among the conductive material that respectively forms in part each one of the at least first and second housing modules, a conductive material, which does not function as the antenna, is connected to a ground of the antenna or a ground of the electronic device.

9. The electronic device of claim 1, wherein the printed circuit board includes a matching circuit configured to adjust a characteristic of the antenna.

10. The electronic device of claim 1, wherein an auxiliary antenna pattern is formed on the non-conductive material of the second housing module, the auxiliary antenna pattern being connected to the conductive material that functions as the antenna, to adjust a characteristic of the antenna.

11. The electronic device of claim 1, wherein the first and second housing modules are mechanically attachable via at least one of a snap fit, a press fit, an interlocking fit and a screw-implemented mechanism.

12. The electronic device of claim 1, wherein the conductive material of the second housing module is electrically connected to the at least one power feeding unit via a mechanically biased connection, the mechanically biased connection comprising an elastic contact terminal or a cable connector.

13. A housing of an electronic device, the housing comprising:

at least first and second housing modules configured to be mechanically attachable to and detachable from each other, wherein the second housing module includes a non-conductive material having an inner surface, and a conductive material forming an exterior surface of the electronic device; and at least one antenna disposed on the inner surface of the second housing module, wherein each of the conductive material and the at least one antenna is electrically connected with a respective antenna power feeding unit within the housing.

14. The housing of claim 13, wherein the conductive material of each one of the at least first and second housing modules are physically separated from each other, and form at least one side surface of the housing.

15. The housing of claim 13, wherein at least one of the at least first and second housing modules is formed by joining the conductive material to a non-conductive material, or by coating or depositing the conductive material on a non-conductive material.

16. The housing of claim 13, wherein the at least first and second housing modules includes a third housing module joined to a lower end of the first housing module, wherein:

the first housing module includes a display device; and the second housing module is joined to an upper end of the first housing module.

17. The housing of claim 16, wherein the third housing module is detachable/attachable from/to the first housing module.

18. An electronic device comprising:

a first housing module, on which a display device is mounted;

a second housing module fastened to the first housing module; and a printed circuit board mounted on the first housing module, the printed circuit board including an antenna power feeding unit;

wherein the second housing module includes a conductive material and a non-conductive material, the conductive material is electrically connected to the antenna power feeding unit to function as an antenna for transmitting/receiving a wireless signal, and wherein an auxiliary antenna pattern is disposed on a surface of the non-conductive material, the auxiliary antenna pattern being electrically connected to the conductive material and configured to adjust a characteristic of the antenna.

19. The electronic device of claim 18, wherein the second housing module is fastened to wrap a part of the first housing module.

20. The electronic device of claim 19, wherein the non-conductive material of the second housing module wraps a top end surface and a part of a rear surface of the first housing module, and the conductive material of the second housing module is joined to the non-conductive material of the second housing module to wrap an edge of a front surface, a part of a side surface, and a part of a rear surface of the first housing module.

21. The electronic device of claim 18, wherein the printed circuit board further includes a matching circuit configured to adjust a characteristic of the antenna.

* * * * *